US006973970B2

(12) United States Patent
Johnston et al.

(10) Patent No.: US 6,973,970 B2
(45) Date of Patent: Dec. 13, 2005

(54) APPARATUS AND METHODS FOR ESTABLISHING SECONDARY HYDRAULICS IN A DOWNHOLE TOOL

(75) Inventors: Russell A. Johnston, Alvin, TX (US); Michael A. Dowling, Bellevue, WA (US)

(73) Assignee: Schlumberger Technology Corporation, Sugar Land, TX (US)

( * ) Notice: Subject to any disclaimer, the term of this patent is extended or adjusted under 35 U.S.C. 154(b) by 209 days.

(21) Appl. No.: 10/460,546

(22) Filed: Jun. 12, 2003

(65) Prior Publication Data

US 2003/0234104 A1 Dec. 25, 2003

Related U.S. Application Data

(60) Provisional application No. 60/390,925, filed on Jun. 24, 2002.

(51) Int. Cl.[7] ..... E21B 29/00
(52) U.S. Cl. ..... 166/298; 166/376; 166/55.3
(58) Field of Search ..... 166/298, 55.7, 166/55.6, 55.2, 55.3, 55, 376; 175/257, 258, 175/259, 263, 265, 266, 273, 284, 286

(56) References Cited

U.S. PATENT DOCUMENTS 2,180,693 A * 11/1939 Reed ..... 166/55.3
4,574,889 A 3/1986 Pringle
4,577,694 A 3/1986 Brakhage, Jr.
4,944,351 A 7/1990 Eriksen et al.
4,981,177 A 1/1991 Carmody et al.
5,249,630 A 10/1993 Meaders et al.
5,361,843 A 11/1994 Shy et al.
5,390,742 A 2/1995 Dines et al.
5,564,675 A 10/1996 Hill, Jr. et al.
5,598,864 A 2/1997 Johnston et al.
6,260,850 B1 7/2001 Beall et al.

OTHER PUBLICATIONS

Schlumberger Data Sheet, "TRM-4P-DS and -4HP—DS Series", pp. 7-8, undated.
Schlumberger Data Sheet, "TRDP/TRSP Series", pp. 15-16, undated.
Schlumberger Data Sheet, "Shear Sleeve Shifting Tools", pp. 22, undated.
Camco General Equipment Catalog, "Safety Control Systems", 1980-1981, pp. 1359-1373.

* cited by examiner

*Primary Examiner*—David Bagnell
*Assistant Examiner*—Matthew J. Smith
(74) *Attorney, Agent, or Firm*—Winstead Sechrest & Minick, P.C; Kevin P. McEnaney; Jaime A. Castaño

(57) ABSTRACT

A tool for making a cut inside a downhole tool, including a housing adapted to move in the downhole tool, a plurality of openings in a wall of the housing that provides a passage from inside the housing to an exterior of the housing, a plurality of cutters disposed in the housing that are adapted to protrude from the plurality of openings to the exterior of the housing, wherein the plurality of cutters provides 360 degree cutting regardless of the orientation of the tool, and an actuation mechanism adapted to force the plurality of cutters to protrude through the plurality of openings.

22 Claims, 9 Drawing Sheets

APPARATUS AND METHODS FOR ESTABLISHING SECONDARY HYDRAULICS IN A DOWNHOLE TOOL

CROSS-REFERENCE TO RELATED APPLICATION

This invention claims priority pursuant to 35 U.S.C. § 119 of U.S. Provisional Patent Application Ser. No. 60/390,925, filed on Jun. 24, 2002. This Provisional Application is hereby incorporated by reference in its entirety.

BACKGROUND OF THE INVENTION

1. Field of the Invention

The present invention relates to a device and method for providing secondary hydraulics in a downhole tool.

2. Background Art

"Full bore opening" safety valves have an opening through the valve that is substantially equal to the internal diameter of the attached tubing or completion string. The safety valves have a valve member therein (e.g. a rotatable ball or a pivoted flapper). The valve member may be shifted to its open position by an actuating sleeve that is axially mounted within the valve housing and operated by one or more hydraulic piston cylinders supplied by one or more control lines. The piston cylinder typically operates by shifting the actuating sleeve downward, resulting in the valve head moving into its open position. Pressurized control fluid for operating the piston cylinder is typically supplied from the surface by a hydraulic control line that communicates with a control fluid passage in the wall of the valve housing. When the valve is in the fully open position, the actuating sleeve is spring loaded and biased to move the valve into its closed position in the event of a loss of hydraulic control. A valve of this general type is disclosed in U.S. Pat. No. 4,716,969.

Various methods and systems have been designed to lock the valve member open in the event of any failure in the operation of the primary piston cylinder. In such an event, it is necessary to replace the defective safety valve with a functional safety valve. One typical manner of remediation, that one skilled in the art would appreciate, is to insert an in-tubing safety valve (or replacement safety valve) within the bore of the original defective safety valve while the original defective safety valve is locked in its, fully open position.

Such replacement valves are generally inserted by wireline, or slickline. The problem arises as to how the already installed hydraulic control line and hydraulic piston cylinder, sometimes referred to collectively by one skilled in the art as the "control fluid piping" or "control fluid conduit", can be used to control the replacement safety valve.

U.S. Pat. No. 3,696,868 discloses an in-tubing replacement valve that may be installed in a defective safety valve, wherein the wall of the actuating sleeve of the defective valve is perforated prior to the insertion of the replacement valve in order to provide communication with the existing control fluid piping. A problem associated with this approach, that would be appreciated by one skilled in the art, stems from the possibility that perforating the originally installed safety valve sleeve may significantly damage the surrounding elements, including the exisiting hydraulic piston cylinder and/or the hydraulic control line.

Other prior art approaches to re-using the control line with the replacement safety valves use spare ports built into the original safety valve housing. These spare ports are closed with sealing elements or threaded plugs that can be removed by or after insertion of the replacement safety valve. However, a problem associated with this approach, that would be appreciated by one skilled in the art, stems from the possibility that the sealing element or threaded plug may leak or fail due to the high pressure, high temperature and/or caustic environment (e.g. in a well, or a pipeline). A similar device using this approach, disclosed in U.S. Pat. No. 3,799,258, proposes using a hollow, shearable, threaded nipple disposed in the wall of the original safety valve housing. The threaded nipple has an inwardly projecting end that may be sheared off by a sleeve that can be moved downwardly by a suitable tool conveyed through the tubing or completion string.

Although these prior art devices provide some ways to establish communication with an existing control fluid piping, there is a need for improved apparatus and methods for establishing such communication with less risk of leakage and/or damage to the surrounding elements.

SUMMARY

In one aspect, embodiments of the invention relate to a tool for making a cut inside a downhole tool (or safety valve). A tool for making a cut inside a downhole tool in accordance with one embodiment of the invention includes a housing adapted to move in the downhole tool, a plurality of openings in a wall of the housing that provide a passage from inside the housing to an exterior of the housing, a plurality of cutters disposed in the housing that are adapted to protrude from the plurality of openings to the exterior of the housing, wherein the plurality of cutters provides 360 degree cutting regardless of the orientation of the tool, and an actuation mechanism adapted to force the plurality of cutters to protrude through the plurality of openings.

In another aspect, embodiments of the invention relate to a system for establishing a new hydraulic line from an existing hydraulic line in a wall of a downhole tool (or safety valve). A system for establishing a new hydraulic line from an existing hydraulic line in a wall of a downhole tool in accordance with one embodiment of the invention includes a downhole tool having a section of the wall thinned from inside the downhole tool to expose a wall of the existing hydraulic line and a tool comprising a plurality of cutters arranged to pierce the exposed wall of the existing hydraulic line regardless of the tool's orientation.

In another aspect, embodiments of the invention relate to a method for establishing a new hydraulic line from an existing hydraulic line in a wall of a downhole tool. A method for establishing a new hydraulic line from an existing hydraulic line in a wall of a downhole tool in accordance with one embodiment of the invention includes positioning a tool inside the downhole tool proximate a location where a section of the wall of the downhole tool is thinned from inside the downhole tool to expose a wall of the existing hydraulic line and actuating the tool to deploy cutters about a full perimeter of the tool and thereby cut the exposed wall of the existing hydraulic line.

In another aspect, embodiments of the invention relate to a method for establishing a new hydraulic line from an existing hydraulic line in a wall of a safety valve. A method for establishing a new hydraulic line from an existing hydraulic line in a wall of a safety valve in accordance with one embodiment of the invention includes positioning a tool inside the safety valve proximate a location where a section of the wall of the safety valve is thinned from inside the safety valve to expose a wall of the existing hydraulic line, actuating the tool to deploy cutters about a full perimeter of the tool and thereby cut the exposed wall of the existing hydraulic line, retrieving the tool, positioning a replacement safety valve inside the safety valve proximate the location where a section of the wall of the safety valve is thinned to expose a wall of the existing hydraulic line and setting the replacement safety valve to establish communication between the replacement safety valve and the existing hydraulic line.

Other aspects of the invention will become apparent from the following description, the drawings, and the claims.

DETAILED DESCRIPTION

The present invention relates to apparatus and methods for establishing or opening communication to an existing control line, hydraulic line or hydraulic piston cylinder (sometimes collectively referred to by one skilled in the art as control fluid piping or fluid conduit) for the operation of, for example, a replacement safety valve. For clarity, the following description assumes the fluid control lines are for controlling safety valves. However, one of ordinary skill in the art would appreciate that embodiments of the present invention are not so limited. Instead, embodiments of the invention may also be applied to control lines for other devices. According to one embodiment of the present invention, secondary hydraulics for a replacement safety valve can be established by opening communication to a hydraulic piston cylinder and hydraulic control line by cutting, piercing or puncturing the hydraulic piston cylinder that operates a primary (or original) full bore safety valve.

Figure 1:
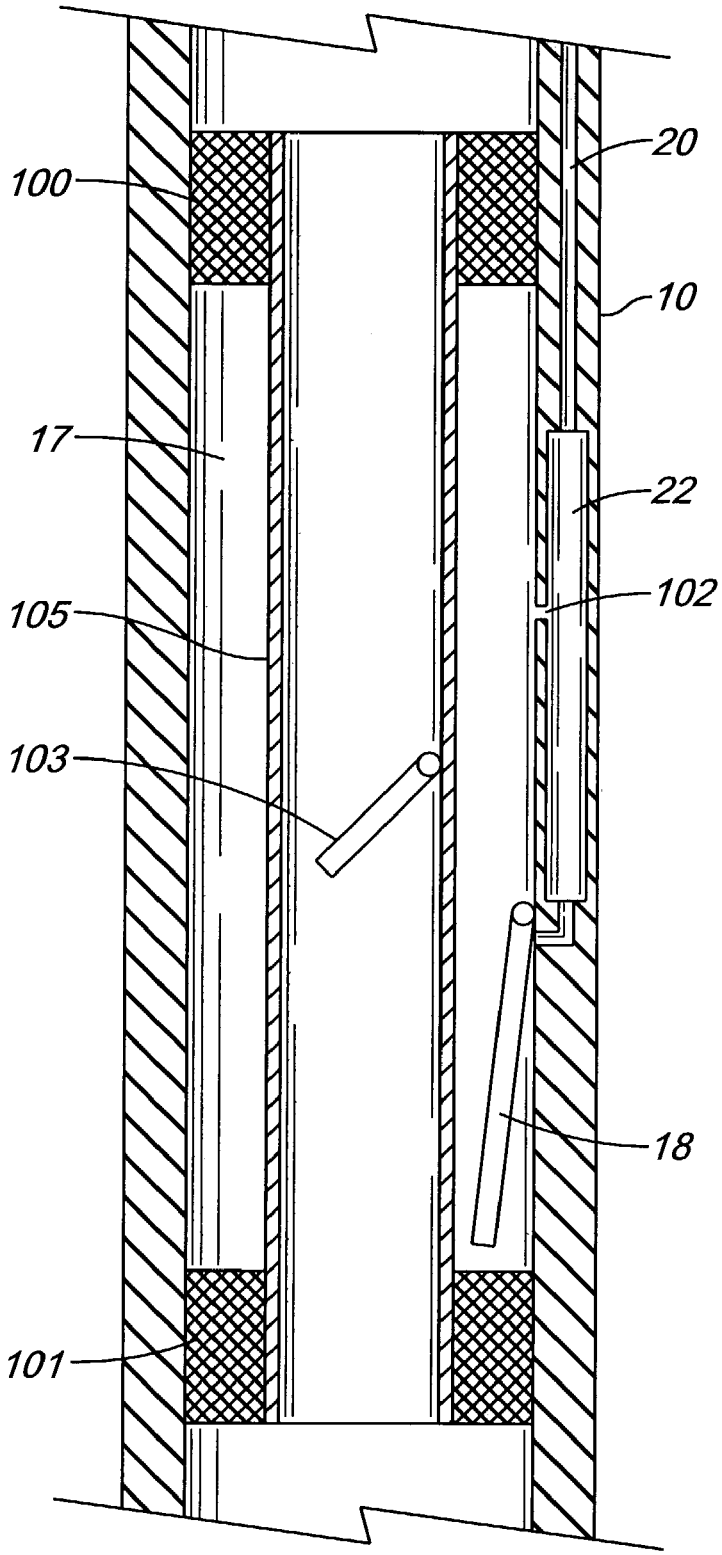
FIG. 1 is an illustration of a replacement safety valve, set inside a primary safety valve, utilizing the existing fluid conduit, according to one embodiment of the present invention, after the opening tool has been run.

FIG. 1 illustrates, according to one embodiment of the present invention, how a replacement safety valve 105 may be positioned in a primary safety valve 10 after a cutting (or opening) tool (not shown) has performed the function of puncturing a piston cylinder 22 and establishing secondary hydraulics. The replacement safety valve 105 may be typically run in the well on wireline and disposed within the original safety valve 10, adjacent to the puncture 102 in the original piston cylinder 22. This operation also ensures that the original flapper valve 18 remains in the locked open state. The upper packer element 100 and the lower packer element 101 are set in order to position the replacement safety valve 105. This isolates an annular space 17 around the replacement safety valve 105 and allows for communication between the replacement flapper valve 103 and the hydraulic control line 20 via the puncture 102 in the piston cylinder 22.

Figure 2:
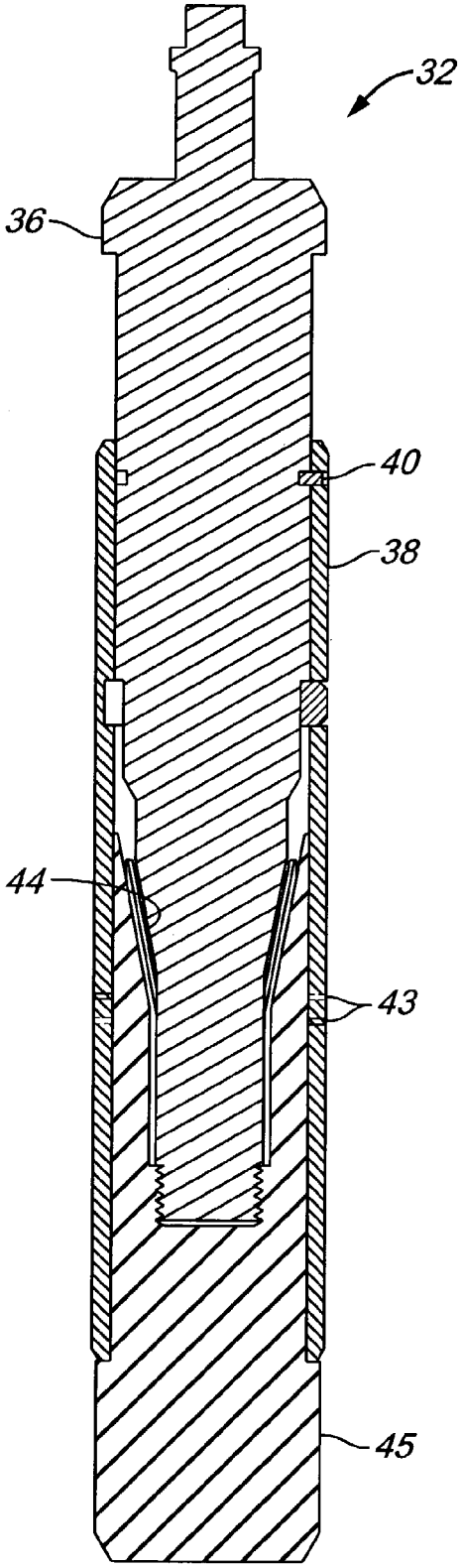
FIG. 2 is an illustration of an opening tool according to one embodiment of the present invention.

FIG. 2 shows an opening tool 32, according to one embodiment of the present invention, which may be conveyed into a well (or pipeline) on the end of slickline, wireline, tubing, or by being pumped in below or in front of a pig. The opening tool 32 comprises an inner mandrel 36, which is disposed inside a housing (or outer sleeve) 38 and secured to the outer housing 38 by shear pins 40. After shear pins 40 are sheared, the inner mandrel 36 is free to move downward within the housing 38 into a base 45. The shape of the mandrel 36 includes a sloped surface (or ramp) area 44, which allows the mandrel 36 to act as an actuation mechanism by forcing one or more cutting (or opening) elements (also called cutters or dogs) (not shown) to move outward through housing openings (or slots) 43 in the housing 38. The housing openings 43 provide a passage from inside the housing 38 to an exterior of the housing 38, thus allowing the one or more dogs (not shown) to freely pass though the housing 38 and protrude from the slot 43 in order to cut (or open) a hydraulic line or piston cylinder (not shown).

While the opening tool 32 is deployed in or retrieved from the pipe (or completion) string, the cutters (or dogs) should be restrained from protruding through the housing openings 43. A retracting mechanism (or restraining device) (shown as 300 in FIG. 3), restrains the cutting elements either completely inside the housing 38 or within the housing openings 43. The retracting mechanism (shown as 300 in FIG. 3) may also act in concert with the actuation mechanism (not shown), which allows the dogs to move outward in order to open fluid communication to an existing hydraulic line. According to one embodiment of the invention, the dogs are restrained inside the housing slots 43 of housing 38 during deployment or retrieval, and during actuation are allowed to move outward through the housing slots 43.

Figure 3:
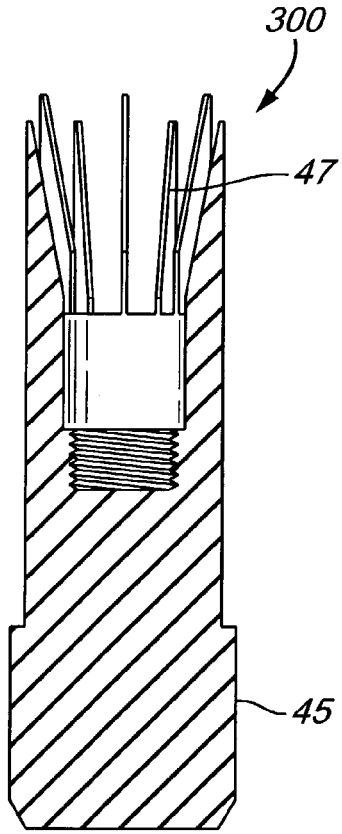
FIG. 3 is an illustration of fingers on which cutting elements or dogs are seated, according to one embodiment of the present invention.

FIG. 3 is an illustration of one embodiment of a retracting mechanism 300 (a dogs restraining device) that can be used with the opening tool (shown as 32 in FIG. 2). As shown, the upper portion of the retracting mechanism 300 is comprised of one or more fingers 47. Each of the fingers 47 goes through a slot (shown as 46 in FIG. 4) in a dog (shown as 42 in FIGS. 4 and 5) and the wedge shape of the finger pulls the dog inward when the base 45 is in the up position. When the base 45 is pushed down by the mandrel (shown as 36 in FIG. 2), the thinner portion of the fingers 47 makes room for the dogs to move outward. As the ramp area (shown as 44 in FIG. 2) of the mandrel (shown as 36 in FIG. 2) is forced down, through the center of the fingers 47 into the base 45, it forces the dogs (shown as 42 in FIGS. 4 and 5) from a retracted position to a second, protruded (or expanded) position.

It would be appreciated by one of ordinary skill in the art that, according to other embodiments (not shown) of the present invention, the retracting and/or actuation mechanisms may comprise mechanical or motorized devices. For example in one embodiment cutting elements may be spring-loaded such that the cutting elements will automatically retract when the mandrel is moved upward. In other embodiments (not shown) the dogs may be secured to fingers that are either spring-loaded or constructed of some strong, flexible material, known or appreciated by one of ordinary skill in the art, that allows the fingers to move outward when the mandrel moves downward and retract as the mandrel moves upward. In other embodiments (not shown) the cutting elements may be actuated and/or retracted by a downhole motor or pump powered by a battery, an energy cell, an electric line, flowing fluid or other means that would be appreciated by one of ordinary skill in the art.

Figure 4:
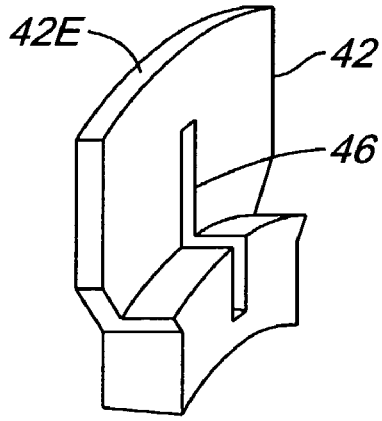
FIG. 4 is an illustration of a cutting element or dog according to one embodiment of the present invention.

FIG. 4 illustrates a closer view of one embodiment of a dog 42, having a flat edge 42*e*, with a mounting slot 46, through which a finger (shown as 47 in FIG. 3) passes, according to one embodiment of the present invention. The cutting edge 42*e* of the dogs may be flat, pointed, or may have a fine edge. The dog 42 may be made of a material suitable for performing the desired cutting operation.

Figure 5:
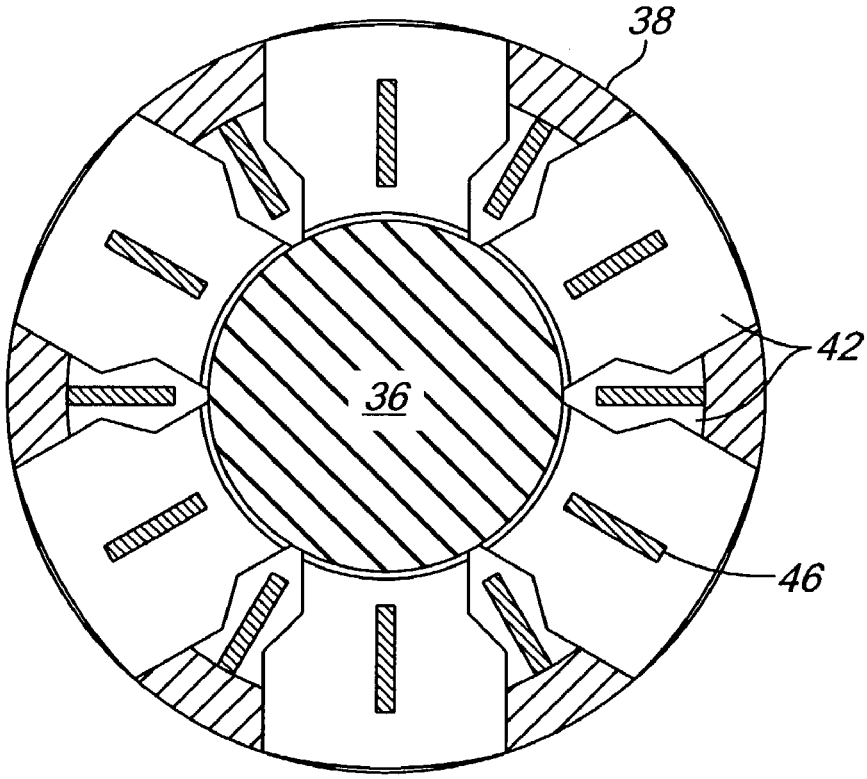
FIG. 5 is an illustration of two sets of offset dogs according to one embodiment of the present invention.

FIG. 5 illustrates one exemplary arrangement of the dogs 42 in an opening tool (shown as 32 in FIG. 2). As shown in FIG. 5, two sets of dogs (six in each set), deployed about the full perimeter of the tool, are axially offset by 30 degrees relative to each other so that they can cover the entire periphery (or circumference) of the housing 38 regardless of the tool orientation. Note that the offset degrees between the sets of dogs are preferably based on the number of dogs in each set. With this arrangement, at least one of the dogs 42 is aligned to open fluid communication with the hydraulic line regardless of the orientation of the opening tool. One of ordinary skill in the art would appreciate that the particular embodiment shown in FIG. 5 is for illustration and other modifications are possible without departing from the scope of the invention. For example, it is possible to use different numbers of dogs or different numbers of sets of dogs or to use a single dog together with a mechanism to orient the opening tool (not shown).

With an arrangement shown in FIG. 5, when the mandrel 36 of the opening tool moves downward, the increasing diameter of the mandrel 36 (see FIG. 2) forces the dogs 42 to move outward, through slotted openings (shown as housing openings 43 in FIGS. 2 and 6) in the housing 38. The housing openings (shown as housing slots 43 in FIGS. 2 and 6) may also function to prevent the dogs 42 from slipping downward while at the same time allowing the dogs 42 to move outward through the housing 38. The fingers (shown as 47 in FIG. 3) that pass through mounting slots 46 and hold the dogs 42 in position also move downward when the base (shown as 45 in FIGS. 2 and 3) is pushed downward by the mandrel 36. Due to the wedge shape of the fingers (shown as 47 in FIG. 3), the downward movement of the fingers makes it possible for the dogs 42 to be pushed outward by the mandrel 36.

After the opening operation, the mandrel 36 is retracted upward, leaving room for the dogs 42 to be retracted inside the housing 38. The upward movement of the mandrel 36 also permits the base (shown as 45 in FIGS. 2 and 3), hence fingers (shown as 47 in FIG. 3), to move upward. The upward movement of the fingers forces the dogs 42 to move inward, due to the wedge shape of the fingers. Once the dogs 42 are retracted inside the housing 38, the opening tool is ready to be retrieved (or removed) from the pipe (or safety valve).

Figure 6:
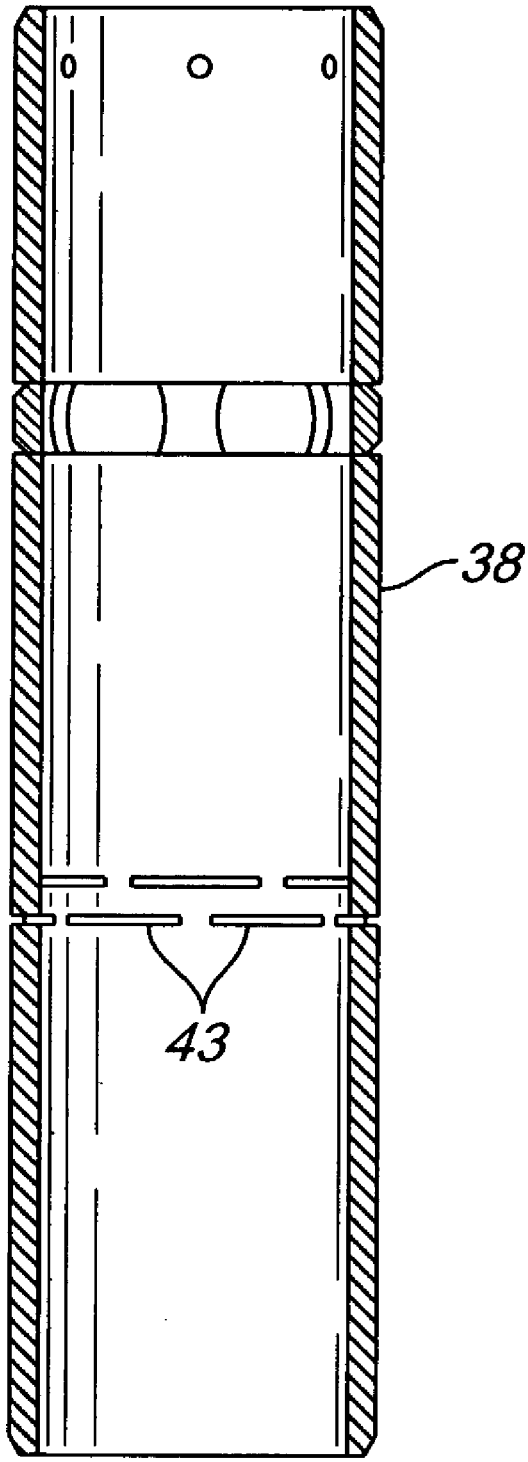
FIG. 6 is an illustration of an opening tool housing according to one embodiment of the present invention.

FIG. 6 illustrates an embodiment of a housing 38 that may be used with the cutting element (dog) arrangement shown in FIG. 5, according to one embodiment of the present invention. As shown, two sets of circumferential housing slots 43 in the opening tool housing 38 are offset by 30 degrees relative to one another. The housing openings 43 are adapted to be disposed in such a way as to allow the dogs (shown as 42 in FIG. 5) to pass through the housing 38.

Figure 7:
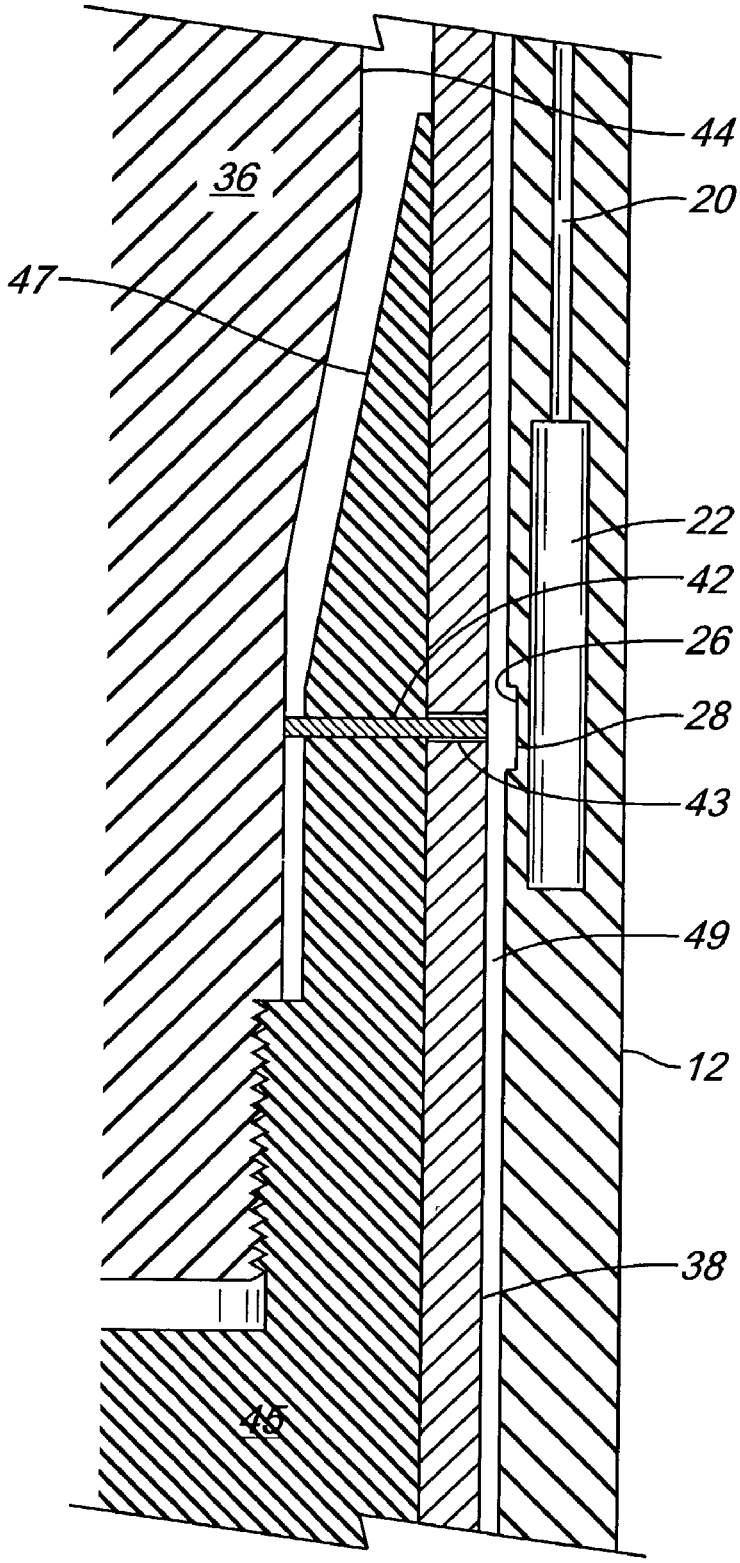
FIG. 7 is an illustration of an opening tool seated inside a safety valve just prior to actuating, according to one embodiment of the present invention.

FIG. 7 illustrates an opening tool (shown as 32 in FIG. 2) inside a primary safety valve (shown as 10 in FIG. 1), according to one embodiment of the present invention. The safety valve piston cylinder 22 has a thin wall 28 (also shown as 22 and 28 in FIG. 8) due to the formation of a recess 26 in the safety valve housing 12 (or in some other downhole tool or in the wall of the pipe in the completion string). During an operation, the opening tool inner mandrel 36 moves downward inside the opening tool housing 38. As the increasing external diameter of ramp area 44 moves downward, it pushes the dogs 42 outward, while fingers 47 and the base 45 are pushed downward by the mandrel 36. The dogs are pushed outward through housing openings 43 in opening tool housing 38 into recess 26 to puncture thin wall 28 of the piston cylinder 22 in safety valve housing 12. The cutting or puncturing operation opens the internal bore 49 of the completion string to fluid communication with control line 20.

Figure 8:
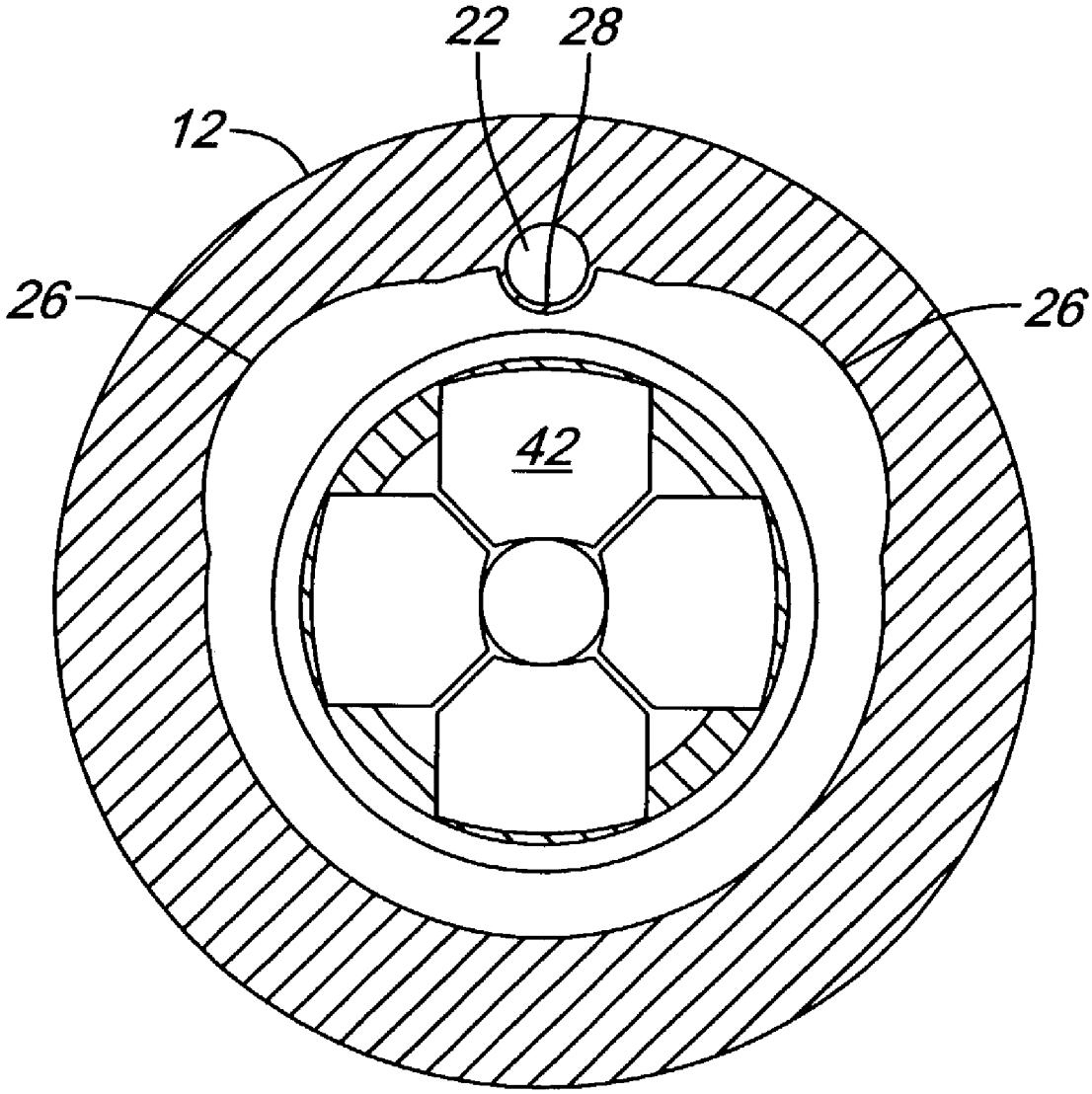
FIG. 8 is an illustration of a cross section showing a thin wall between the piston cylinder and dogs.

FIG. 8 shows a cross section illustrating the creation of recess 26 to expose a thin wall 28 around the piston cylinder 22. It is clear that the thin wall 28 is exposed and adapted to be cut by one of the dogs 42. While this illustration shows the creation of a "localized" recess 26 around the piston cylinder 22, an alternative is to thin the wall 12 of the safety valve housing (or the wall of the pipe in the completion string) around the entire periphery.

Figure 9A:
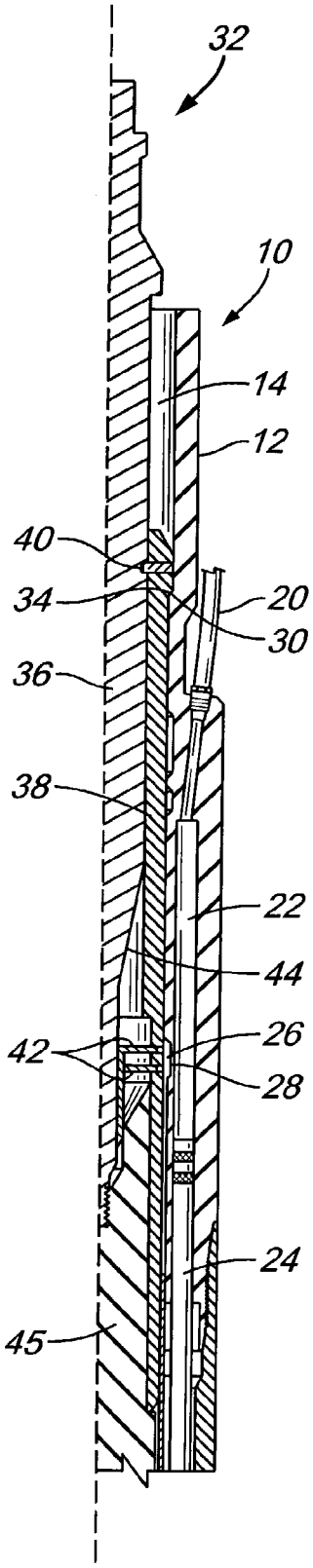
FIGS. 9A–9B are illustrations of the opening tool seated inside a safety valve, prior to actuation, according to one embodiment of the present invention.
Figure 9B:
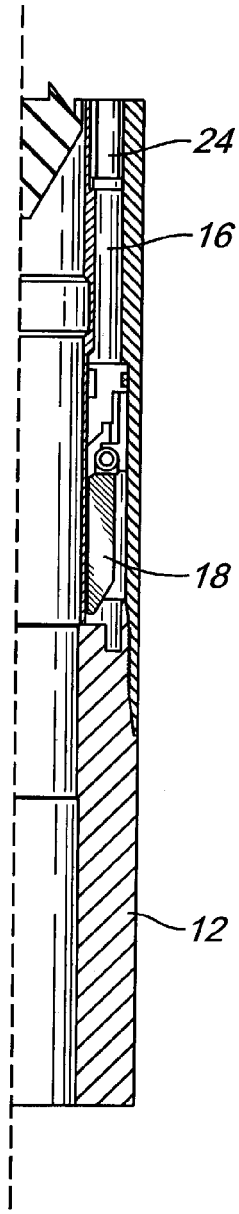

FIGS. 9A–9B shows an opening tool 32 in accordance with one embodiment of the invention disposed in a safety valve 10 ready to perform a cutting (or opening) operation to open the existing hydraulic control line. As shown, the safety valve 10 comprises a housing 12 defining a bore 14 therethrough, a valve operator 16 (e.g., a sleeve), and a valve member 18 (shown as a flapper valve). A control line 20 extended from the surface (or from a location downhole) communicates with a piston cylinder 22. A piston 24 in the piston cylinder 22 moves in response to the application of hydraulic fluid pressure in the piston cylinder 22. The piston 24 is connected to and moves the valve operator 16.

The safety valve 10 further comprises a recess 26 in the housing 12 that extends circumferentially around the periphery of the housing 12. In other embodiments (not shown), the recess may not extend around the full periphery of the housing 12 or may be only a thinner section of the perimeter of the inner wall of the housing. In the embodiment illustrated in FIGS. 9A–9B, the piston cylinder 22, which intersects and extends through the recess 26, has a relatively thin wall 28 in the portion of the recess 26.

An opening (or cutting) tool 32 has a locator (or stop structure) 34 on its external surface, typically referred to as a mating shoulder, sized to engage a positioning structure 30, typically referred to as a no-go, on the inside of a pipe (or safety valve). In this embodiment, the positioning structure (or no-go) 30, located on the internal surface of the safety valve, facilitates axial positioning of the opening (or cutting) tool 32. The opening tool 32 has an inner mandrel 36 and an outer housing 38 thereon. One or more shear pins 40, or similar devices (e.g. a collet) that would be appreciated by one skilled in the art, maintain the relative position of the housing 38 and the mandrel 36 during run-in. One or more dogs 42 are provided between the mandrel 36 and the housing 38. While running through the pipe string and into the safety valve 10, the dogs 42 are disposed in a first, retracted position.

Figure 10A:
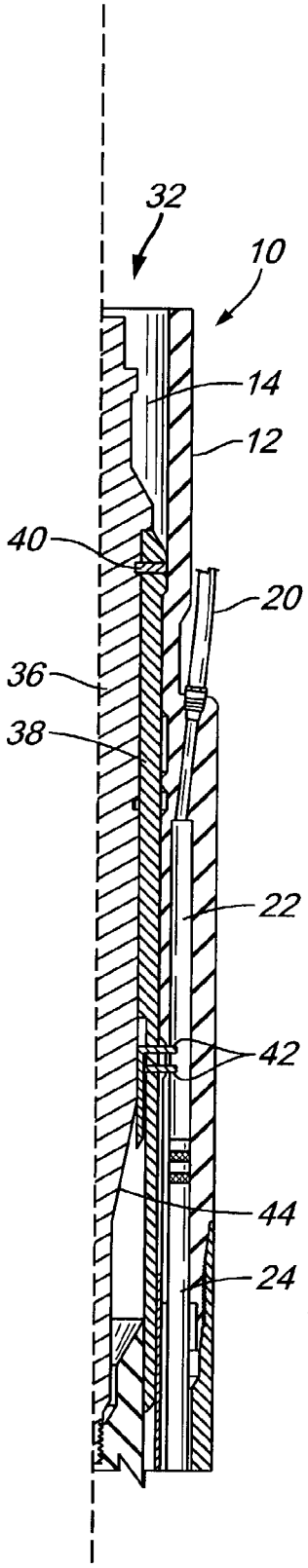
FIGS. 10A–10B are illustrations of the opening tool seated inside a safety valve, after actuation, according to one embodiment of the present invention.
Figure 10B:
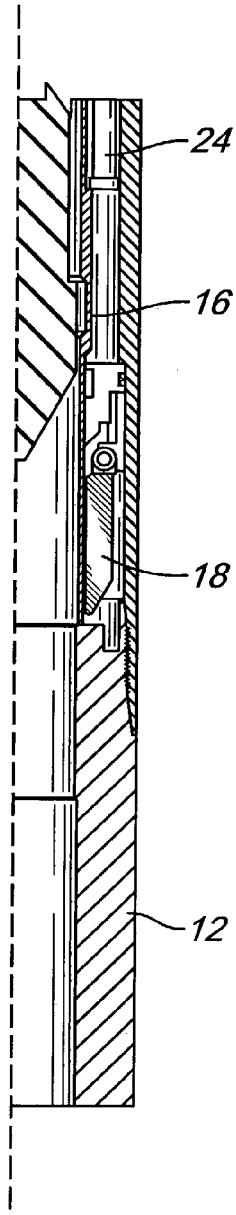

When the opening tool 32 no-gos (seats or stops) in the safety valve 10, the dogs are aligned with the recess 26. When a downward force is applied, by a variety of means (including, applying pump pressure, actuating wireline or slickline jars, rotating tubing string, or reciprocating tubing string), to the opening tool 32, the shear pins 40 are sheared to allow the mandrel 36 to move inside the housing 38. The mandrel 36 moves down relative to the housing 38 and forces the base 45 to move down. The external diameter of the mandrel 36 has an upwardly increasing ramp area 44, which forces the dogs 42 from the retracted position to a second, or expanded, position as shown in FIGS. 10A–10B. When expanded, the dogs 42 puncture or pierce the thin wall 28 to establish (or open) fluid communication between the piston cylinder 22 and the bore 14.

Figure 11:
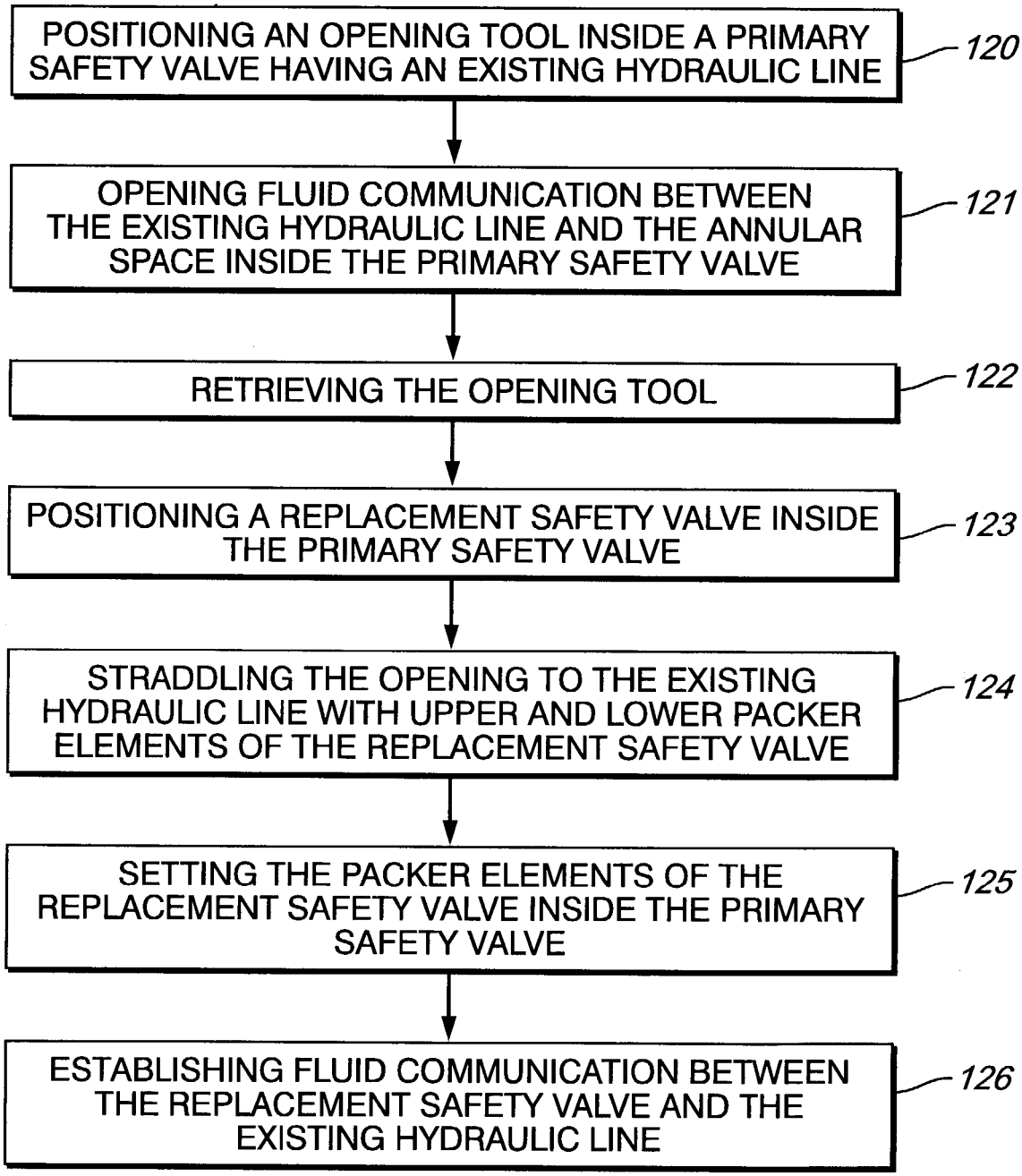
FIG. 11 illustrates a method of providing secondary hydraulics in a safety valve.

FIG. 11 illustrates a method according to one embodiment of the present invention. First, an opening tool is conveyed through a pipe string and seated at a selected location inside the pipe string (or inside a primary safety valve), which is equipped with a fluid conduit (which may include an existing control line, hydraulic line and/or a hydraulic cylinder) (shown as 120). Next, the opening tool is actuated and an opening to the existing hydraulic line (or cylinder) establishes fluid communication with the annular space inside the pipe string (or the primary safety valve) (shown as 121). After opening the existing hydraulic line, the opening tool is retrieved (shown as 122). Now that a new fluid communication is established with the old (existing or original) hydraulic line, the old hydraulic line can then be used to perform any desired action. For example, in some embodiments, a replacement safety valve may be conveyed through the pipe string and positioned inside the primary safety valve (shown as 123) so that the upper and lower packer elements of the replacement safety valve straddle the opening to the existing hydraulic line (shown as 124). Next, the packer elements of the replacement safety valve are set (shown as 125) and fluid communication between the replacement safety valve and the existing hydraulic line is established (shown as 126).

The advantages of the present invention include convenient methods that allow for secondary hydraulics to be established in a replacement safety valve. These methods can be employed in a cost effective and efficient manner, free from risk of severely damaging surrounding elements with perforations, and without risking unnecessary remedial operations because of leaking plugs in pre-constructed ports. Additionally, the present invention allows for a variety of other remedial operations, that would be appreciated by one of ordinary skill in the art, to be performed that require opening fluid communication with a fluid or hydraulic control line installed in an oil and gas well or pipeline system.

While the invention has been described with respect to a limited number of embodiments, those skilled in the art, having benefit of this disclosure, will appreciate that other embodiments can be devised which do not depart from the scope of the invention as disclosed herein. For example, the above description is of a tool in which the mandrel moves down, however, in another embodiment the mandrel could move up. Accordingly, the scope of the invention should be limited only by the attached claims.

What is claimed is:

1. A tool for making a cut inside a downhole tool, the tool comprising:

a housing adapted to move in the downhole tool;

a plurality of cutters attached to the housing and radially offset to provide 360 degree; cutting, an actuation mechanism adapted to force the plurality of cutters from a non-protruding position retracted within the housing to a protruding position radially extended from the housing; and a retracting mechanism having a plurality of fingers adapted to pass through opening in each of the plurality of cutters to move the plurality of cutters from the protruding position to the non-protruding position.

2. The tool of claim 1, wherein the plurality of cutters comprises two sets of axially offset cutters.

3. The tool of claim 2, wherein the two sets are disposed offset by a selected angle relative to each other such that when all cutters in the two sets are forced to the protruding position, their exterior edges cover substantially complete periphery around the housing regardless of the tool orientation.

4. The tool of claim 1, further comprising a locator that is adapted to engage a positioning structure on an inside of the downhole tool.

5. The tool of claim 1, wherein the actuation mechanism comprises a mandrel having a sloped surface, the mandrel is adapted to move such that the sloped surface is adapted to push the plurality of cutters outward.

6. The tool of claim 1, wherein the actuation mechanism is actuated by a mechanical actuator or a motorized actuator.

7. A system for establishing a new hydraulic line from an existing hydraulic line in a wall of a downhole tool, comprising:

the downhole tool having a section of the wall thinned from inside the downhole tool to expose a wall of the existing hydraulic line; and a tool having a plurality of cutters comprising two sets of axially offset cutters arranged to pierce the exposed wall of the existing hydraulic line regardless of the tool's orientation.

8. The system of claim 7, wherein the tool further comprises a retracting mechanism adapted to retract the plurality of cutters from a protruding position to a non-protruding position.

9. The system of claim 8, wherein the retracting mechanism comprises a plurality of fingers, the plurality of fingers adapted to pass through openings in cutters for retracting the plurality of cutters.

10. The system of claim 7, wherein the two sets are disposed offset by a selected angle relative to each other such that when all cutters in the two sets are forced to protrude to an exterior of a housing of the tool, their exterior edges cover substantially complete periphery around the housing.

11. The system of claim 7, further comprising a locator that is adapted to engage a positioning structure on an inside of the downhole tool.

12. The system of claim 7, wherein the actuation mechanism comprises a mandrel having a sloped surface, the mandrel being adapted to move inside a housing of the tool such that the sloped surface is adapted to push the plurality of cutters outward.

13. The system of claim 7, wherein the actuation mechanism is actuated by a mechanical actuator or a motorized actuator.

14. The system of claim 7, wherein the downhole tool comprises a safety valve.

15. The system of claim 7, wherein the downhole tool comprises a pipe.

16. A method for establishing a new hydraulic line from an existing hydraulic line in a wall of a downhole tool, comprising:

positioning a tool inside the downhole tool proximate a location where a section of the wall of the downhole tool is thinned from inside the downhole tool to expose a wall of the existing hydraulic line; and actuating the tool to deploy two sets of axially offset cutters about a full perimeter of the tool and thereby cut the exposed wall of the existing hydraulic line.

17. The method of claim 16, further comprising retracting the cutters from a protruding position to a non-protruding position.

18. The method of claim 16, further comprising offsetting the two sets by a selected angle relative to each other such that when all cutters in the two sets are forced to protrude to an exterior of a housing of the tool, their exterior edges cover substantially complete periphery around the housing.

19. The method of claim 16, wherein positioning the tool comprises engaging a locator on the tool with a positioning structure on an inside of the downhole tool.

20. The method of claim 16, wherein the downhole tool comprises a pipe.

21. The method of claim 16, wherein the downhole tool comprises a safety valve.

22. The method of claim 21, further comprising:

retrieving the tool;

positioning a replacement safety valve inside the safety valve proximate the location where a section of the wall of the safety valve is thinned to expose a wall of the existing hydraulic line; and setting the replacement safety valve to establish communication between the replacement safety valve and the existing hydraulic line.

* * * * *